US008319451B2

(12) United States Patent
Anissimov

(10) Patent No.: US 8,319,451 B2
(45) Date of Patent: Nov. 27, 2012

(54) TWO LIGHT LEVEL CONTROL CIRCUIT

(75) Inventor: Viatcheslav Anissimov, Lynn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 175 days.

(21) Appl. No.: 13/024,387

(22) Filed: Feb. 10, 2011

(65) Prior Publication Data

US 2012/0206061 A1 Aug. 16, 2012

(51) Int. Cl.
*H05B 37/02* (2006.01)

(52) U.S. Cl. ..... 315/291; 315/209 R; 315/283; 315/287; 315/299

(58) Field of Classification Search ..... 315/209 R, 315/224, 226, 283, 287, 291, 299
See application file for complete search history.

(56) References Cited

U.S. PATENT DOCUMENTS 4,052,751 A * 10/1977 Shepard ..... 361/50
4,383,204 A 5/1983 Roberts
4,963,795 A 10/1990 Nilssn
5,309,062 A 5/1994 Perkins et al.
5,831,395 A 11/1998 Mortimer et al.
6,177,769 B1 1/2001 Bezdon
7,084,579 B2 * 8/2006 Konopka et al. ..... 315/209 R
7,129,648 B2 * 10/2006 Fischer et al. ..... 315/224
7,218,063 B2 * 5/2007 Konopka et al. ..... 315/291
8,072,158 B2 * 12/2011 Nerone ..... 315/294

FOREIGN PATENT DOCUMENTS

WO 02/39788 A1 5/2002

* cited by examiner

*Primary Examiner* — Thuy Vinh Tran
(74) *Attorney, Agent, or Firm* — Shaun P. Montana

(57) ABSTRACT

A ballast to power a lamp includes two switches, each to selectively connect the ballast to respective high voltage terminals, each having two states (ON and OFF). The ballast also includes a converter circuit that provides a voltage to energize the lamp, and a detector circuit. The detector circuit includes two inputs, each coupled to a respective switch; two resistors, each coupled to a respective input; two outputs, each connected to the converter circuit; a transistor network; and a capacitor. One output provides the converter circuit with power, and is connected to the input via the resistors. The other provides the converter circuit with a control signal, indicating a voltage level so as to power the lamp to a particular light level, depending on the switches' states. The transistor network detects a differential voltage between the inputs, generating the control signal as a result. The capacitor smoothes the control signal.

20 Claims, 3 Drawing Sheets

TWO LIGHT LEVEL CONTROL CIRCUIT

TECHNICAL FIELD

The present invention relates to lighting, and more specifically, to control circuits for electronic lighting ballasts.

BACKGROUND

Multiple level lighting systems allow a user to set the level of light the user desires to receive from the lamp or lamps within the lighting system. For example, a two level lighting systems allows the user to select between two different levels of light: full on, such that the lamp or lamps in the lighting system is/are at their maximum output setting, and half on, such that the lamp or lamps in the lighting system is/are at half of their maximum output setting. As a result, multiple level lighting systems are typically used in overhead lighting applications, to give the user a choice between levels of light.

A typical implementation of a two level lighting system includes two power switches and two ballasts. Each power switch in the lighting system controls only one of the ballasts in the lighting system. Turning on both of the switches at the same time powers both ballasts, thus producing full light output from the lighting system. Turning on only one of the switches applies power to only one of the ballasts in the lighting system and thus results in a reduced light level and a corresponding reduction in power consumed.

SUMMARY

The conventional two level lighting system described above suffers from a variety of deficiencies, most notably in economy. It is more economical to use only a single ballast instead of the two ballasts typically found in the conventional two level lighting system. For compatibility purposes, the single ballast would be required to operate from the same two power switches used in the two ballast system. When both switches are closed, the ballast would operate in a full light mode. Conversely, when only one of the two power switches is closed, the ballast would operate in a reduced light mode.

Embodiments of the present invention provide a multiple level lighting system using a single ballast that overcomes the deficiencies of the conventional two level lighting systems. In particular, embodiments are directed to a ballast having a first switch and a second switch that selectively connect the ballast, respectively, to a first power line and to a second power line. The ballast includes a lighting system converter circuit that provides voltage to energize one or more lamps connected to the ballast, and a detector circuit that controls the lighting system converter circuit based on the states of the first and second switches. The detector circuit is self-powered via the first power line and the second power line.

The magnitude of the voltage provided by the lighting system converter circuit varies so that the one or more lamps operate at multiple lighting levels. In some embodiments, the one or more lamps are operated at either full output or half output based on the states of the first and second switches. The detector circuit includes a transistor network to detect the states of the first and second switches and generates a direct current (DC) control signal that controls the magnitude of the voltage provided to the one or more lamps by the lighting system converter circuit.

In an embodiment, there is provided a ballast to power at least one lamp from an alternating current (AC) voltage supply. The ballast includes: a first switch adapted to selectively connect the ballast to a first high voltage terminal of the AC voltage supply, the first switch having an on state and an off state; a second switch adapted to selectively connect the ballast to a second high voltage terminal of the AC voltage supply, the second switch having an on state and an off state; a lighting system converter circuit to provide voltage suitable to energize the at least one lamp; and a detector circuit. The detector circuit includes: a first input terminal coupled to the first switch; a second input terminal coupled to the second switch; a first resistor R1 connected to the first input terminal; a second resistor R2 connected to the second input terminal; a first output terminal connected to the lighting system converter circuit, wherein the first output terminal provides a supply current to the lighting system converter circuit to power components of the lighting system converter circuit, and wherein the first output terminal is connected to first input terminal via the first resistor R1 and to the second input terminal via the second resistor R2; a second output terminal connected to the lighting system converter circuit, wherein the second output terminal provides a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp; a transistor network to detect a differential voltage between the first input terminal and the second input terminal and to generate a control signal as a function thereof; and a capacitor connected to the transistor network to smooth the control signal from the transistor network to provide a substantially direct current (DC) control signal. The lighting system converter circuit receives the DC control signal via the second output terminal of the detector circuit and provides voltage to the at least one lamp as a function of the DC control signal.

In a related embodiment, the transistor network may include a first transistor and a second transistor, each having a base, an emitter, and a collector, wherein the emitter of the second transistor and the base of the first transistor may be connected to the first switch via the first resistor, and wherein the emitter of the first transistor and the base of the second transistor may be connected to the second switch via the second resistor.

In another related embodiment, the detector circuit may further include an overvoltage protection circuit. In a further related embodiment, the overvoltage protection circuit may include a first diode having an anode and a cathode, a second diode having an anode and a cathode, and a resistor, wherein the anode of the first diode may be connected to the second switch via the second resistor and the anode of the second diode may be connected to the first switch via the first resistor, and wherein the cathode of the first diode and the cathode of the second diode may be connected to the first output via the resistor.

In yet another related embodiment, the ballast may further include a diode and an other resistor, wherein the diode and the other resistor may each be connected in parallel with the capacitor. In still another related embodiment, the ballast may further include an inverting stage circuit to invert the logic levels of the DC control signal. In a further related embodiment, the inverting stage circuit may include a transistor connected between the capacitor and the second output terminal of the detector circuit. In still yet another related embodiment, the ballast may further include a full wave rectifier connected between the first and second switches and the lighting system converter circuit.

In another embodiment, there is provided a ballast to power at least one lamp from an alternating current (AC) voltage supply. The ballast includes: a first switch adapted to selectively connect the ballast to a first high voltage terminal of the AC voltage supply, the first switch having an on state and an off state; a second switch adapted to selectively connect the ballast to a second high voltage terminal of the AC voltage supply, the second switch having an on state and an off state; a lighting system converter circuit to provide voltage suitable to energize the at least one lamp; and a detector circuit. The detector circuit includes: a first input terminal coupled to the first switch; a second input terminal coupled to the second switch; a first resistor connected to the first input terminal; a second resistor connected to the second input terminal; an output terminal connected to the lighting system converter circuit to provide a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp; a first transistor having a base, an emitter, and a collector; a second transistor having a base, an emitter, and a collector, wherein the emitter of the second transistor and the base of the first transistor are connected to the first switch via the first resistor, wherein the emitter of the first transistor and the base of the second transistor are connected to the second switch via the second resistor; and a capacitor having a first node connected to the collector of the first transistor, the collector of the second transistor, and the output terminal, the capacitor having a second node connected to ground potential, wherein the capacitor smoothes current from the collectors of the first and second transistors to provide a substantially direct current (DC) control signal. The lighting system converter circuit receives the DC control signal via the second output of the detector circuit and provides voltage to the at least one lamp as a function of the DC control signal.

In a related embodiment, the detector circuit may further include an other output terminal connected to the lighting system converter circuit to provide a supply current to the lighting system converter circuit to power components of the lighting system converter circuit, wherein the other output terminal may be connected to the first input terminal via the first resistor and to the second input terminal via the second resistor. In another related embodiment, the detector circuit may further include an overvoltage protection circuit, including: a first diode having an anode and a cathode; a second diode having an anode and a cathode; and a resistor; wherein the anode of the first diode may be connected to the second switch via the second resistor and the anode of the second diode may be connected to the first switch via the first resistor, and wherein the cathode of the first diode and the cathode of the second diode may be connected to the first output via the resistor.

In still another related embodiment, the ballast may further include a diode and an other resistor, wherein the diode and the other resistor may each be connected in parallel with the capacitor. In yet another related embodiment, the ballast may further include an inverting stage circuit to invert the logic levels of the control signal. In still yet another related embodiment, the inverting stage circuit may include a transistor connected between the capacitor and the second output terminal of the detector circuit. In yet still another related embodiment, the ballast may further include a full wave rectifier connected between the first and second switches and the lighting system converter circuit.

In another embodiment, there is provided a ballast to power at least one lamp from an alternating current (AC) voltage supply. The ballast includes: a first switch adapted to selectively connect the ballast to a first high voltage terminal of the AC voltage supply, the first switch having an on state and an off state; a second switch adapted to selectively connect the ballast to a second high voltage terminal of the AC voltage supply, the second switch having an on state and an off state; a lighting system converter circuit to provide voltage suitable to energize the at least one lamp; and a detector circuit. The detector circuit includes: a first input terminal coupled to the first switch; a second input terminal coupled to the second switch; a first resistor connected to the first input terminal; a second resistor connected to the second input terminal; a first output terminal connected to the lighting system converter circuit to provide a supply current to the lighting system converter circuit to power components of the lighting system converter circuit, wherein the first output terminal is connected to the first input terminal via the first resistor and to the second input terminal via the second resistor; a second output terminal connected to the lighting system converter circuit to provide a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp; a first transistor having a base, an emitter, and a collector; a second transistor having a base, an emitter, and a collector, wherein the emitter of the second transistor and the base of the first transistor are connected to the first switch via the first resistor, wherein the emitter of the first transistor and the base of the second transistor are connected to the second switch via the second resistor; and a capacitor connected to the collector of the first transistor and the collector of the second transistor and connected to the second output terminal to smooth current from the collectors of the first and second transistors to provide a substantially direct current (DC) control signal. The lighting system converter circuit receives the DC control signal via the second output terminal of the detector circuit and provides voltage to the at least one lamp as a function of the DC control signal.

In a related embodiment, the detector circuit may further include an overvoltage protection circuit, the overvoltage protection circuit including a first diode having an anode and a cathode, a second diode having an anode and a cathode, and a resistor, wherein the anode of the first diode may be connected to the second switch via the second resistor and the anode of the second diode may be connected to the first switch via the first resistor, and wherein the cathode of the first diode and the cathode of the second diode may be connected to the first output terminal via the resistor.

In another related embodiment, the ballast may further include a diode and an other resistor, wherein the diode and the other resistor may each be connected in parallel with the capacitor. In still another related embodiment, the ballast may further include an inverting stage circuit to invert the logic levels of the control signal, the inverting stage circuit including a transistor connected between the capacitor and the second output terminal of the detector circuit. In yet another related embodiment, the ballast may further include a full wave rectifier connected between the first and second switches and the lighting system converter circuit.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
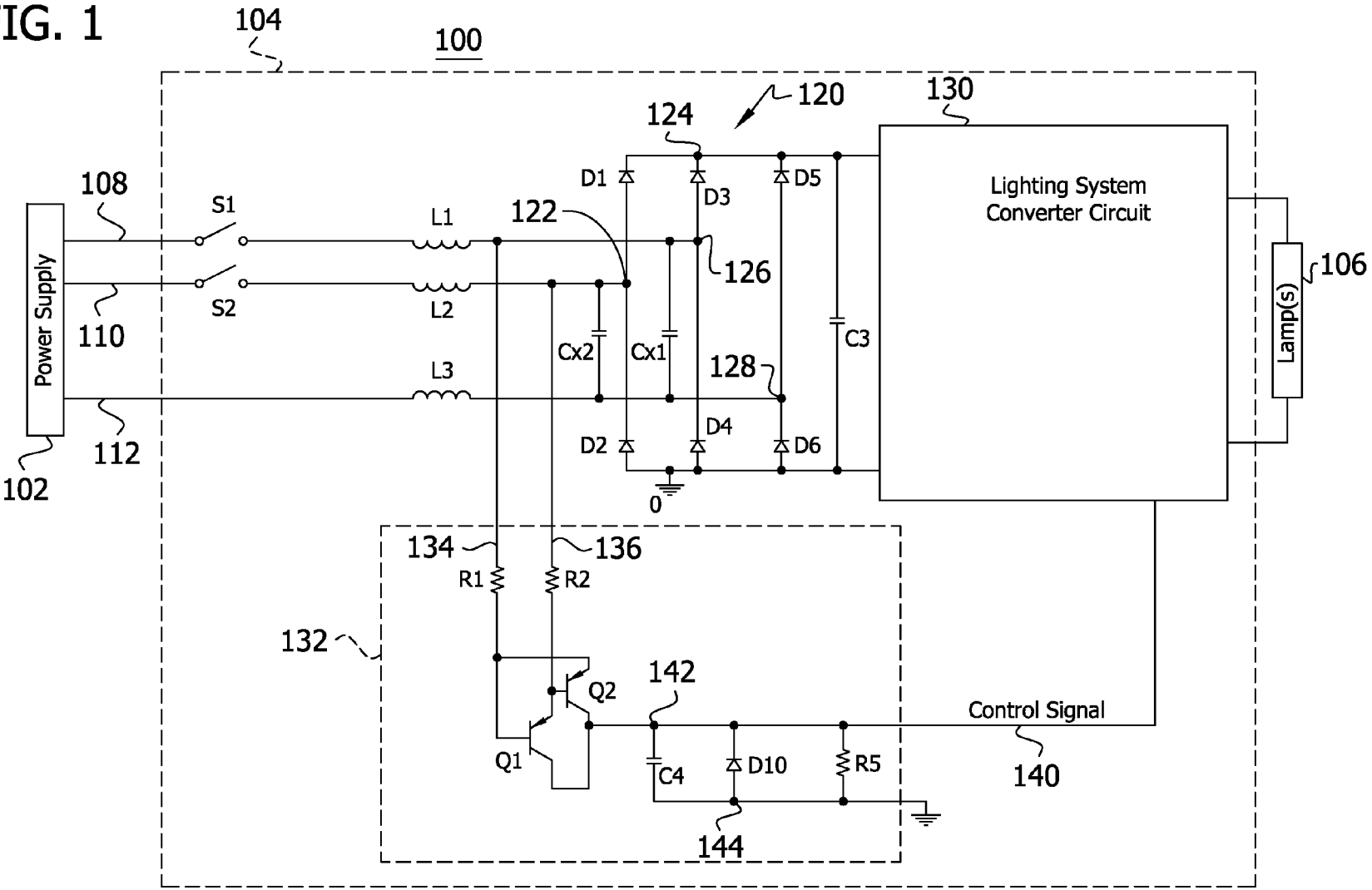
FIG. 1 is a schematic diagram, partially in block form, of a lamp system according to embodiments disclosed herein.

FIG. 1 illustrates a lamp system 100 according to an embodiment of the invention. The lamp system 100 includes an input power source, such as but not limited to an alternating current (AC) power supply 102. The lamp system 100 also includes an electronic ballast 104 (hereinafter ballast 104) and a lamp 106. Although the lamp 106 is illustrated as a single lamp, the lamp 106 may be one lamp or a plurality of lamps connected together in series or in parallel. In some embodiments, the lamp 106 is an electrodeless gas discharge lamp, such as but not limited to the ICETRON® lamp available from OSRAM SYLVANIA, the QL induction lamp available from Philips, the GENURA lamp available from General Electric, and the EVERLIGHT lamp available from Matsushita. In other embodiments, the lamp 106 may be a lamp that includes solid state light sources, such as but not limited to one or more light emitting diode(s) (LED). The lamp system 100 may be used to energize other types of lamps not specifically mentioned herein without departing from the scope of the invention.

The ballast 104 includes a first high voltage input terminal 108 (i.e., line voltage input terminal, hot input terminal) to connect to a first high voltage terminal (e.g., hot wire) of the AC power supply 102, (e.g., standard 120V or 240V AC household power), and a second high voltage input terminal 110 (i.e., line voltage input terminal) to connect to a second high voltage terminal of the AC power supply 102. The ballast 104 also includes a neutral input terminal 112 to connect to a neutral wire of the AC power supply 102, and a ground terminal (not shown) connectable to ground potential. A first switch S1 is connected to the first high voltage input terminal 108. Accordingly, the first switch S1 is adapted to selectively connect the ballast 104 to the first high voltage terminal of the AC voltage source 102. A second switch S2 is connected to the second high voltage input terminal 110. As such, the second switch S2 is adapted to selectively connect the ballast 104 to the second high voltage terminal of the AC voltage source 102. The first switch S1 and the second switch S2 may be implemented by, but are not limited to, conventional wall switches having an on state and an off state.

A rectifier circuit 120 is coupled to the first high voltage input terminal 108, the second high voltage input terminal 110, and the neutral terminal 112. In particular, the rectifier circuit 120 is coupled to the first high voltage input terminal 108 via the first switch S1 and a first electromagnetic interference (EMI) inductor L1. The rectifier circuit 120 is coupled to the second high voltage input terminal 110 via the second switch S2 and a second EMI inductor L2. The rectifier circuit 120 is coupled to the neutral terminal 112 via a third EMI inductor L3. In FIG. 1, the rectifier circuit 120 is a full-wave rectifier implemented by an arrangement comprising six diodes D1, D2, D3, D4, D5, and D6. The first diode D1 has an anode coupled to a first node 122 and a cathode coupled to a second node 124. The first node 122 is coupled to the second high voltage input terminal 110 via the second EMI inductor L2. The second diode D2 has an anode coupled to ground potential and a cathode coupled to first node 122. The third diode D3 has an anode coupled to a third node 126 and a cathode coupled to the second node 124. The third node 126 is coupled to first high voltage input terminal 108 via the first EMI inductor L1. The fourth diode D4 has an anode coupled to the ground potential and a cathode coupled to third node 126. The fifth diode D5 has an anode coupled to a fourth node 128 and a cathode coupled to second node 124. The fourth node 128 is coupled to the neutral input terminal 112 via the third EMI inductor L3. The sixth diode D6 has an anode coupled to ground potential and a cathode coupled to the fourth node 128.

A first EMI capacitor Cx1 is connected between the first high voltage input terminal 108 and the neutral terminal 112. A second EMI capacitor Cx2 is connected between the second high voltage input terminal 1 and the neutral terminal 112. Specifically, the first EMI capacitor Cx1 is connected between the third node 126 and the fourth node 128. The second EMI capacitor Cx2 is connected between the first node 122 and the fourth node 128. As shown in FIG. 1, a high frequency bypass capacitor C3 may be connected between the fourth node 128 and the ground potential.

In operation, the ballast 104 selectively receives a sinusoidal AC voltage signal from the AC power supply 102 via the first switch S1 and/or the second switch S2. The EMI inductors (L1, L2, and L3), and the EMI capacitors (Cx1 and Cx2) reduce high frequency noise generated by the ballast 104. The rectifier circuit 120 receives the AC voltage signal and generates a rectified voltage signal therefrom. The high frequency bypass capacitor C3 reduces high frequency noise in the rectified voltage signal. A lighting system converter circuit 130 is coupled to the rectifier circuit 120 via the high frequency bypass capacitor C3. The lighting system converter circuit 130 receives the rectified voltage signal and provides a voltage and current suitable to energize the lamp 106. For example, in some embodiments, the lighting system converter circuit 130 may include a power factor correction circuit and an inverter circuit.

The ballast 104 includes a detector circuit 132. The detector circuit 132 provides a control signal to the lighting system converter circuit 130 as a function of the states of the first switch S1 and the second switch S2. In some embodiments, the control signal is a voltage signal having a magnitude (e.g., voltage level) that is dependent on the states of the first switch S1 and the second switch S2. In turn, the lighting system converter circuit 130 provides a voltage signal to the lamp 106 as a function of the control signal. The lamp 106 generates a particular amount of light (e.g., lumens, lighting level) as a function of the voltage signal (e.g., voltage level, voltage magnitude) provided to the lamp 106 by the lighting system converter circuit 130. For example, in FIG. 1, when both the first switch S1 and the second switch S2 are in the ON state, the magnitude of the control signal is at a first level (e.g., low level, 0 volts) causing the lighting system converter circuit 130 to operate the lamp 106 at a first lighting level (e.g., 100% of full light output). When only one of the first switch S1 and the second switch S2 is in the ON state, the magnitude of the control signal is at a second level (e.g., high level, defined by a breakdown voltage of a Zener diode D10, for instance 15 volts), causing the lighting system converter circuit 130 to operate the lamp 106 at a second lighting level (e.g., 50% of full light output).

In some embodiments, the detector circuit 132 includes a first input terminal 134 coupled to the first switch S1 via the first inductor L1, and a second input terminal 136 coupled to the second switch via the second inductor L2. The first input terminal 134 receives an AC current signal when the first switch S1 is connected to the AC power supply 102 (e.g., when the first switch S1 is ON). The second input terminal 136 receives an AC current signal when the second switch S2 is connected to the AC power supply 102 (e.g., when the second switch S2 is ON). The detector circuit 132 includes a transistor network configured to detect a differential current and/or differential voltage between the first input terminal 134 and the second input terminal 136. The transistor network provides a control signal output indicative of whether one of the first and second switches (S1, S2) or both the first and the second switch (S1 and S2) are connected to the AC power supply (e.g., operating in the ON state). A capacitor C4 is connected to the transistor network to smooth the control signal from the transistor network. Thus, the capacitor C4 provides a substantially direct current (DC) control signal. The detector circuit 132 includes an output terminal 140 connected to the lighting system converter circuit 130. The lighting system converter circuit 139 receives the DC control signal via the output terminal 140 of the detector circuit 132 and provides voltage to the lamp as a function of the DC control signal.

In FIG. 1 as shown, the transistor network is implemented via a first current limiting resistor R1, a second current limiting resistor R2, a first transistor Q1, and a second transistor Q2. For example, the first transistor Q1 and the second transistor Q2 may each be, but are not limited to, a bipolar PNP transistor available from Fairchild Semiconductor. The first transistor Q1 and the second transistor Q2 each have a base, an emitter, and a collector. The emitter of the second transistor Q2 and the base of the first transistor Q1 are connected to the first switch S1 and to the first input terminal 134 via the first current limiting resistor R1. The emitter of the first transistor Q1 and the base of the second transistor Q2 are connected to the second switch S2 and to the second input terminal 136 via the second current limiting resistor R2. The capacitor C4 has a first node 142 and a second node 144. The first node 142 of the capacitor C4 is connected to the collector of the first transistor Q1, the collector of the second transistor Q2, and the output terminal 140 of the detector circuit 132. The second node 144 of the capacitor C4 is connected to ground potential. A diode, such as the Zener diode D10, is connected in parallel with the capacitor C4 to limit the amount of voltage provided at the output terminal 140 of the detector circuit so that it is suitable for controlling the lighting system converter circuit 130. In particular, the Zener diode D10 has an anode connected to the second node 144 of the capacitor C4 and a cathode connected to the first node 142 of the capacitor C4. A resistor R6 is connected in parallel with the capacitor C4 and with the Zener diode D10 to discharge the capacitor C4, providing a fast transition between voltage levels of the DC control signal.

Figure 2:
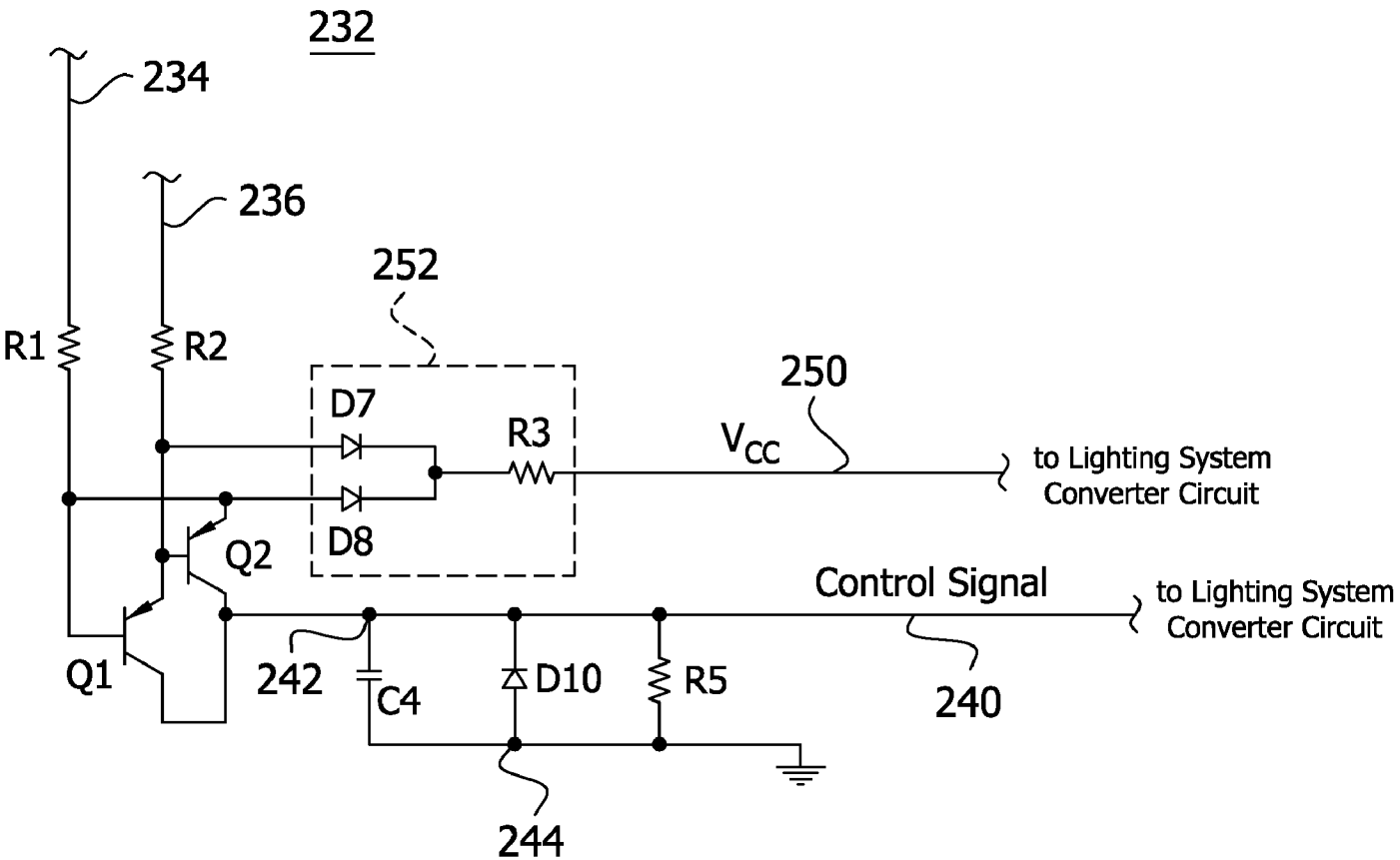
FIG. 2 is a schematic diagram of a detector circuit of a ballast according to embodiments disclosed herein.

FIG. 2 illustrates a detector circuit 232 which, in addition to the components described above in connection with the detector circuit 132, also includes an overvoltage protection circuit 252 connected between the first and second resistors, R1 and R2, and the output terminal 250. The overvoltage protection circuit 252 limits maximum voltage applied to the transistors Q1, Q2 in order to protect them from damage by overvoltage and allows the transistors Q1 and Q2 to be low voltage rated and thereby less expensive. As an additional benefit, the overvoltage protection circuit 252 provides a supply current to a common-collector voltage (VCC bus) signal in the lighting system converter circuit 130. The detector circuit 232 itself does not require a VCC signal for operation. The detector circuit 232 is self-powered via the resistors R1 and R2 from the first high voltage input terminal 108 and the second high voltage input terminal 110. The VCC signal (e.g., 15 Volts) is used to power the components of the lighting system converter circuit 130. In FIG. 2 as shown, the detector circuit 232 includes an output terminal 250 that is connected to the lighting system converter circuit 130, for voltage limiting across the transistors Q1, Q2 and, also for providing supply current to the lighting system converter circuit 130. The output terminal 250 is connected to a first input terminal 234 (analogous to the first input terminal 134 of FIG. 1) via the first resistor R1, and to a second input terminal 236 (analogous to the second input terminal 136 of FIG. 1) via the second resistor R2. The overvoltage protection circuit 252 also includes a first diode D7, a second diode D8, and a resistor R3. The first diode D7 has an anode connected to the second input terminal 236 via the second resistor R2. The second diode D8 has an anode connected to the first input terminal 234 via the first resistor R1. The first diode D7 and the second diode D8 each have a cathode connected to the resistor R3 which is also connected to the output terminal 250.

Figure 3:
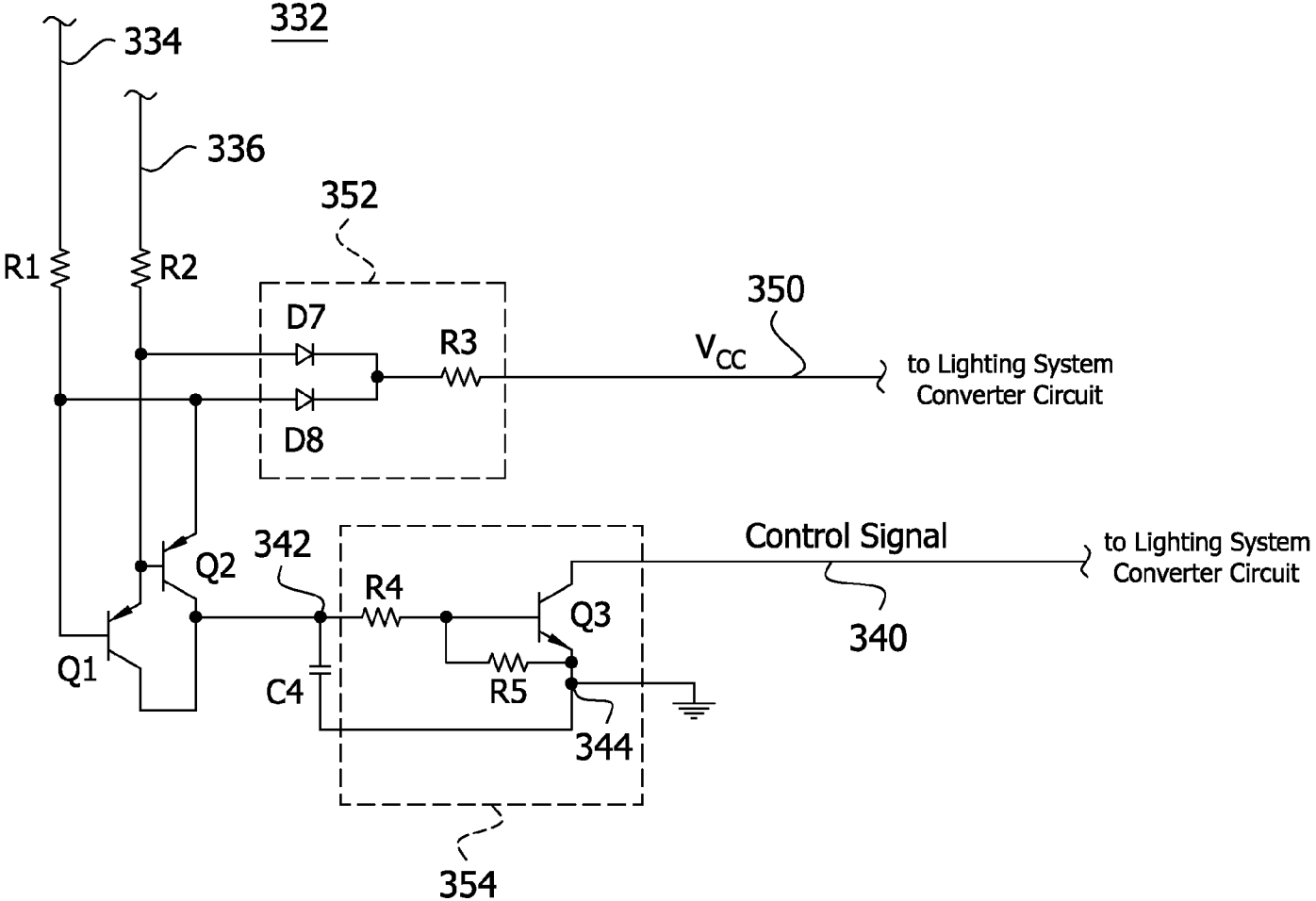
FIG. 3 is a schematic diagram of a detector circuit of a ballast according to embodiments disclosed herein.

FIG. 3 illustrates a detector circuit 332, which includes an inverting stage circuit 354 connected between a capacitor C4 and an output terminal 340. The inverting stage circuit 354 inverts the logic levels of the DC signal output from the capacitor C4. Thus, the DC control signal that is provided to the lighting system converter circuit 130 via the output terminal 340 has inverted logic levels. Accordingly, the inverting stage circuit 354 allows the detector circuit 332 to be used with ballasts that have a lighting system converter circuit 130 configured to operate the lamp 106 at the first lighting level (e.g., 100% of full light output) when the control signal has a high voltage logic level (e.g., 15 volts or other value defined by the components of the lighting system converter circuit 130) and to operate the lamp 106 at the second lighting level (e.g., 50% of full light output) when the control signal has a low voltage logic level (e.g., 0 volts). In FIG. 3, the detector circuit 332 includes a first resistor R4, a second resistor R5, and a transistor Q3 having a collector, a base, an emitter. For example, the transistor Q3 may be, but is not limited to, an NPN bipolar junction transistor. The first resistor R4 is connected between a first node 342 of the capacitor C4 and the base of the transistor Q3. Thus, the base of the transistor Q3 is connected to the first node 342 of the capacitor C4 via the first resistor R4. The second resistor R5 is connected across the base and the emitter of the transistor Q3. The emitter of the transistor Q3 is connected to a second node 344 of the capacitor C4, which is at ground potential. The collector of the transistor Q3 is connected to the output terminal 340.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast to power at least one lamp from an alternating current (AC) voltage supply, the ballast comprising:

a first switch adapted to selectively connect the ballast to a first high voltage terminal of the AC voltage supply, the first switch having an on state and an off state;

a second switch adapted to selectively connect the ballast to a second high voltage terminal of the AC voltage supply, the second switch having an on state and an off state;

a lighting system converter circuit to provide voltage suitable to energize the at least one lamp; and a detector circuit, wherein the detector circuit comprises:

a first input terminal coupled to the first switch;

a second input terminal coupled to the second switch;

a first resistor R1 connected to the first input terminal;

a second resistor R2 connected to the second input terminal;

a first output terminal connected to the lighting system converter circuit, wherein the first output terminal provides a supply current to the lighting system converter circuit to power components of the lighting system converter circuit, and wherein the first output terminal is connected to first input terminal via the first resistor R1 and to the second input terminal via the second resistor R2;

a second output terminal connected to the lighting system converter circuit, wherein the second output terminal provides a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp;

a transistor network to detect a differential voltage between the first input terminal and the second input terminal and to generate a control signal as a function thereof; and a capacitor connected to the transistor network to smooth the control signal from the transistor network to provide a substantially direct current (DC) control signal;

wherein the lighting system converter circuit receives the DC control signal via the second output terminal of the detector circuit and provides voltage to the at least one lamp as a function of the DC control signal.

2. The ballast of claim 1 wherein the transistor network comprises a first transistor and a second transistor, each having a base, an emitter, and a collector, wherein the emitter of the second transistor and the base of the first transistor are connected to the first switch via the first resistor, and wherein the emitter of the first transistor and the base of the second transistor are connected to the second switch via the second resistor.

3. The ballast of claim 1 wherein the detector circuit further comprises an overvoltage protection circuit.

4. The ballast of claim 3 wherein the overvoltage protection circuit comprises a first diode having an anode and a cathode, a second diode having an anode and a cathode, and a resistor, wherein the anode of the first diode is connected to the second switch via the second resistor and the anode of the second diode is connected to the first switch via the first resistor, and wherein the cathode of the first diode and the cathode of the second diode are connected to the first output via the resistor.

5. The ballast of claim 1 further comprising a diode and an other resistor, wherein the diode and the other resistor are each connected in parallel with the capacitor.

6. The ballast of claim 1 further comprising an inverting stage circuit to invert the logic levels of the DC control signal.

7. The ballast of claim 6 wherein the inverting stage circuit includes a transistor connected between the capacitor and the second output terminal of the detector circuit.

8. The ballast of claim 1 further comprising a full wave rectifier connected between the first and second switches and the lighting system converter circuit.

9. A ballast to power at least one lamp from an alternating current (AC) voltage supply, the ballast comprising:

a first switch adapted to selectively connect the ballast to a first high voltage terminal of the AC voltage supply, the first switch having an on state and an off state;

a second switch adapted to selectively connect the ballast to a second high voltage terminal of the AC voltage supply, the second switch having an on state and an off state;

a lighting system converter circuit to provide voltage suitable to energize the at least one lamp; and a detector circuit, wherein the detector circuit comprises:

a first input terminal coupled to the first switch;

a second input terminal coupled to the second switch;

a first resistor connected to the first input terminal;

a second resistor connected to the second input terminal;

an output terminal connected to the lighting system converter circuit to provide a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp;

a first transistor having a base, an emitter, and a collector;

a second transistor having a base, an emitter, and a collector, wherein the emitter of the second transistor and the base of the first transistor are connected to the first switch via the first resistor, wherein the emitter of the first transistor and the base of the second transistor are connected to the second switch via the second resistor; and a capacitor having a first node connected to the collector of the first transistor, the collector of the second transistor, and the output terminal, the capacitor having a second node connected to ground potential, wherein the capacitor smoothes current from the collectors of the first and second transistors to provide a substantially direct current (DC) control signal;

wherein the lighting system converter circuit receives the DC control signal via the second output of the detector circuit and provides voltage to the at least one lamp as a function of the DC control signal.

10. The ballast of claim 9 wherein the detector circuit further comprises an other output terminal connected to the lighting system converter circuit to provide a supply current to the lighting system converter circuit to power components of the lighting system converter circuit, wherein the other output terminal is connected to the first input terminal via the first resistor and to the second input terminal via the second resistor.

11. The ballast of claim 9 wherein the detector circuit further comprises an overvoltage protection circuit, comprising:

a first diode having an anode and a cathode;

a second diode having an anode and a cathode; and a resistor;

wherein the anode of the first diode is connected to the second switch via the second resistor and the anode of the second diode is connected to the first switch via the first resistor, and wherein the cathode of the first diode and the cathode of the second diode are connected to the first output via the resistor.

12. The ballast of claim 9 further comprising a diode and an other resistor, wherein the diode and the other resistor are each connected in parallel with the capacitor.

13. The ballast of claim 9 further comprising an inverting stage circuit to invert the logic levels of the control signal.

14. The ballast of claim 13 wherein the inverting stage circuit comprises a transistor connected between the capacitor and the second output terminal of the detector circuit.

15. The ballast of claim 9 further comprising a full wave rectifier connected between the first and second switches and the lighting system converter circuit.

16. A ballast to power at least one lamp from an alternating current (AC) voltage supply, the ballast comprising:

a first switch adapted to selectively connect the ballast to a first high voltage terminal of the AC voltage supply, the first switch having an on state and an off state;

a second switch adapted to selectively connect the ballast to a second high voltage terminal of the AC voltage supply, the second switch having an on state and an off state;

a lighting system converter circuit to provide voltage suitable to energize the at least one lamp; and a detector circuit comprising:

a first input terminal coupled to the first switch;

a second input terminal coupled to the second switch;

a first resistor connected to the first input terminal;

a second resistor connected to the second input terminal;

a first output terminal connected to the lighting system converter circuit to provide a supply current to the lighting system converter circuit to power components of the lighting system converter circuit, wherein the first output terminal is connected to the first input terminal via the first resistor and to the second input terminal via the second resistor;

a second output terminal connected to the lighting system converter circuit to provide a control signal to the lighting system converter circuit, the control signal indicating one of a plurality voltage levels for providing to the at least one lamp to energize the at least one lamp as a function of the states of the first and second switches, wherein each voltage level corresponds to a different lighting level generated by the at least one lamp;

a first transistor having a base, an emitter, and a collector;

a second transistor having a base, an emitter, and a collector, wherein the emitter of the second transistor and the base of the first transistor are connected to the first switch via the first resistor, wherein the emitter of the first transistor and the base of the second transistor are connected to the second switch via the second resistor; and a capacitor connected to the collector of the first transistor and the collector of the second transistor and connected to the second output terminal to smooth current from the collectors of the first and second transistors to provide a substantially direct current (DC) control signal;

wherein the lighting system converter circuit receives the DC control signal via the second output terminal of the detector circuit and provides voltage to the at least one lamp as a function of the DC control signal.

17. The ballast of claim 16 wherein the detector circuit further comprises an overvoltage protection circuit, the overvoltage protection circuit comprising a first diode having an anode and a cathode, a second diode having an anode and a cathode, and a resistor, wherein the anode of the first diode is connected to the second switch via the second resistor and the anode of the second diode is connected to the first switch via the first resistor, and wherein the cathode of the first diode and the cathode of the second diode are connected to the first output terminal via the resistor.

18. The ballast of claim 16 further comprising a diode and an other resistor, wherein the diode and the other resistor are each connected in parallel with the capacitor.

19. The ballast of claim 16 further comprising an inverting stage circuit to invert the logic levels of the control signal, the inverting stage circuit comprising a transistor connected between the capacitor and the second output terminal of the detector circuit.

20. The ballast of claim 16 further comprising a full wave rectifier connected between the first and second switches and the lighting system converter circuit.

* * * * *